United States Patent [19]

Slocum et al.

[11] 4,035,749

[45] July 12, 1977

[54] MICROWAVE TUNING SCREW ASSEMBLY HAVING POSITIVE SHORTING

[75] Inventors: Mahlon W. Slocum, Middletown; Henri Pachana, Neptune City, both of N.J.

[73] Assignee: Harvard Industries, Inc., Farmingdale, N.J.

[21] Appl. No.: 674,108

[22] Filed: Apr. 6, 1976

[51] Int. Cl.[2] ..... H01P 1/28; H01P 7/06

[52] U.S. Cl. ..... 333/83 R; 279/1 S; 333/98 R

[58] Field of Search ..... 279/1 S; 333/98 R, 83 R

[56] References Cited

U.S. PATENT DOCUMENTS

| | | | |
|---|---|---|---|
| 2,479,697 | 8/1949 | Norton | 333/83 R X |
| 2,566,050 | 8/1951 | Wolf | 333/83 R X |
| 2,594,037 | 4/1952 | Landon et al. | 333/83 R UX |
| 3,615,101 | 10/1971 | Oliver | 279/1 S |

*Primary Examiner*—Paul L. Gensler
*Attorney, Agent, or Firm*—Allan Ratner

[57] ABSTRACT

A microwave tuning screw assembly mounted in an opening in a cavity or waveguide and providing positive shorting at an inner wall of the cavity or waveguide. A chuck section is disposed in the opening and has elastically deformable fingers. A tuning screw section is received within the fingers so that as the fingers are elastically deformed inwardly, they grip the tuning screw section and thus provide positive shorting from the inner wall through the chuck section to the tuning screw section.

13 Claims, 9 Drawing Figures

FIG. 1
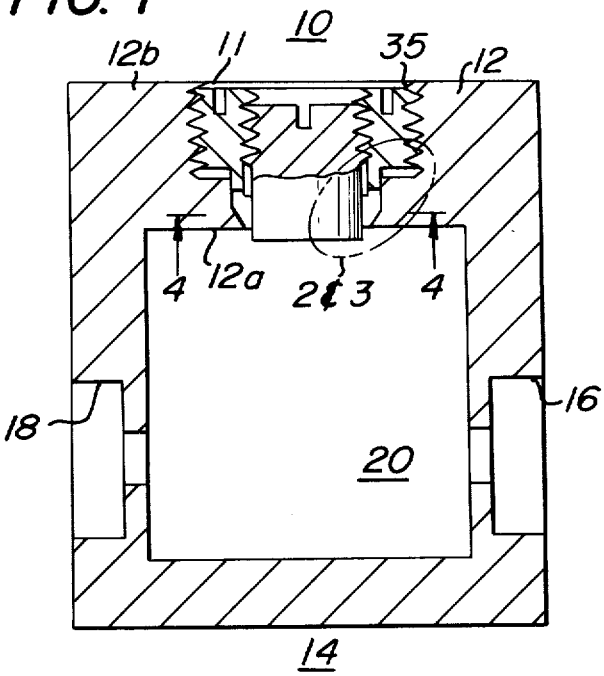
FIG. 2
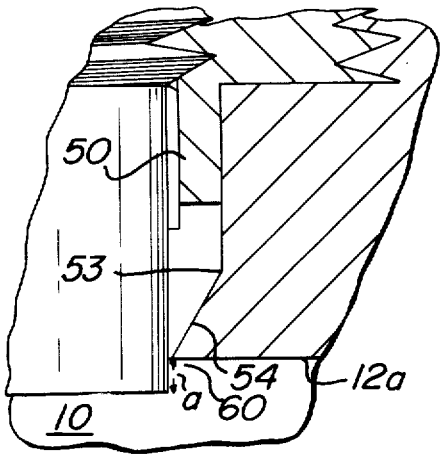
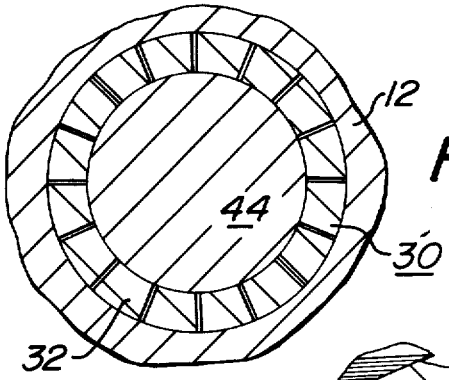
FIG. 4
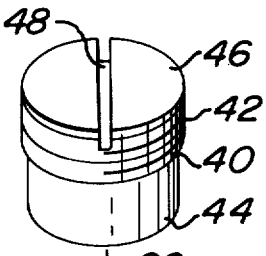
FIG. 5
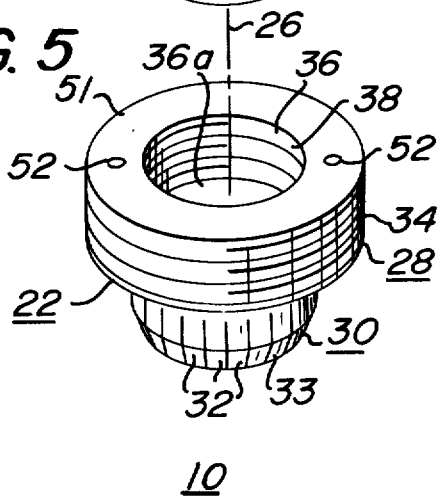
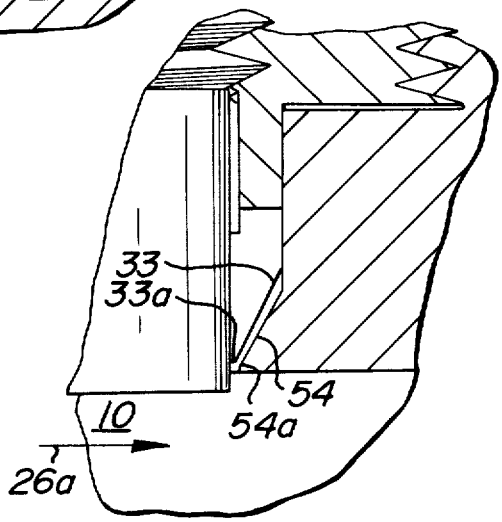
FIG. 3

MICROWAVE TUNING SCREW ASSEMBLY HAVING POSITIVE SHORTING

BACKGROUND OF THE INVENTION

1. Field of the Invention

This invention relates to the field of art of tuning screws used in cavities and waveguides.

2. Prior Art

Known tuning screws provide an impedance adjusting element in the form of a plug, rod or slug which is inserted through an opening in the wall of a waveguide or cavity. The impedance is adjusted by rotating the screw in order to vary the depth of penetration into the waveguide cavity. Prior tuning screws have left much to be desired in that they have suffered from one or more of the problems of lack of repeatability, noisy tuning and insertion loss.

Lack of repeatability results from the change in position of the short circuit between the threads of the tuning screw and the threaded wall when the tuning screw is rotated from a set position and returned to that set position. In view of the inherent variations in thread clearance, the place on the threads of the tuning screw that actually forms the short circuit with the threads in the wall varies and cannot be predicted as the tuning screw is rotated from one position and then returned.

Noisy tuning in prior tuning screws has occurred since the contact between screw and wall has become intermittent as the screw is rotated. Specifically, the short circuit contact between screw and wall threads jumps from place to place upon rotation and such a movable short circuit effectively produces impulse noise.

Ideally, a tuning screw should represent a reactive device with no resistive contribution. A resistive contribution objectionably increases insertion loss in the cavity or waveguide. In prior tuning screws, the short circuit between the threads of screw and wall occurs at some variable distance from the interface of the plug or slug and the actual inner surface of the wall. This extra path length from the interface introduces an objectionable resistive component thereby increasing the insertion loss.

Microwave locking screw assemblies have been known in which there is provided a slot on each side of one of the threads on the screw. This single thread is then deformed to provide an interference when mated with a nut thereby removing any backlash between the male and female threads with slots formed with respect to the split thread. The tuning screw is threaded into an insert and there is thus provided spring loading between the tuning screw and threaded insert to take backlash out of the threads. Such assembly still has left much to be desired in that the points of shorting contact have still varied and not been predictable and vary from thread to thread.

SUMMARY OF THE INVENTION

A tuning screw assembly mounted in an opening in a cavity or waveguide and having positive shorting to an inner wall of the cavity or waveguide. A major portion of chuck means is disposed in the opening and has elastically deformable fingers within the opening. A tuning screw section is received within the fingers and there is provided means for deforming the fingers towards the tuning screw section in this way to provide positive shorting from the inner wall through the chuck means to the tuning screw section.

BRIEF DESCRIPTION OF THE DRAWINGS

FIG. 1 is a sectional view of a tuning screw assembly installed in a microwave cavity embodying the invention;

FIGS. 2 and 3 are enlarged views of a portion of FIG. 1 showing the chuck section in different positions;

FIG. 4 is a sectional view of FIG. 1 taken along lines 4—4;

FIG. 5 is a perspective view of the tuning screw section and chuck section of FIG. 1;

DETAILED DESCRIPTION

Figure 6:
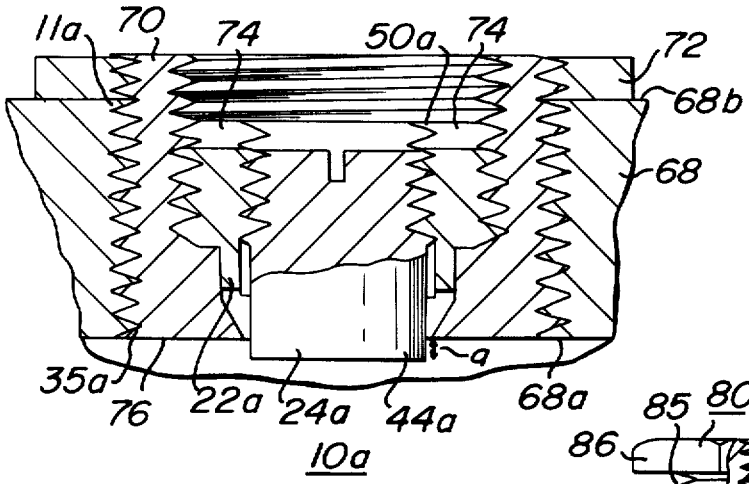
FIG. 6 is another embodiment of the invention having a machined insert.

Referring now to FIGS. 1–5, there is shown a tuning screw assembly 10 which is received within an opening 11 in a wall 12 of a microwave cavity resonator 14. Resonator 14 may be of conventional design and comprise an input 16, an output 18 and a cavity 20.

Tuning screw assembly 10 comprises a chuck section 22 and a solid cylindrical tuning screw section 24 which together with opening 11 have the same longitudinal axis 26 when assembled together as shown in FIG. 1. Chuck section 22 has an upper cylindrically shaped movement portion 28 which is coaxial with a lower cylindrically shaped gripping portion 30. Movement portion 28 has external threads 34 on its outer surface for threaded engagement with internal threads 35 formed in opening 11. Portion 28 has a cylindrical central chamber 36 with internal threads 38 for threaded engagement with external threads 40 formed on the outer surface of upper threaded portion 42 of tuning screw section 24.

Chuck section 22 may be formed of a single piece of metal with gripping portion 30 having a circumferential serrated skirt forming elastically deformable fingers 32. As shown in FIG. 4, fingers 32 are transversely cut in gripping portion 30 with the cuts being substantially radial from axis 26. The outer surface 33 of fingers 32 taper downwardly and inwardly towards axis 26 as best shown in FIGS. 2, 3 and 5. The inner surface of fingers 32 closest to axis 26 form a cylindrical central gripping chamber section **36*a* which is of reduced inner diameter with respect to cylindrical central chamber 36. Section 36*a* forms a gripping surface separated by the serrations between fingers 32 which is adapted to normally loosely engage lower unthreaded plug or slug portion 44. When fingers 32 are elastically deformed toward plug 44** they rigidly grip the plug in the manner to be described.

Upper surface 46 of threaded portion 42 is formed with a slotted opening 48 which is adapted to receive a screwdriver. The upper annular surface 51 of movement portion 28 has openings 52 to receive a spanner wrench.

Opening 11 is formed with a reduced inner diameter cylindrical section 50 which at its lower end starting at circular section 53 tapers downwardly and inwardly towards axis 26 to form a frusto conical seating surface 54.

In the loose assembled position shown in FIG. 3, threaded portion 42 is threadedly engaged within threads 38 and plug portion 44 extends within and through the lower end of gripping section 36*a* of portion 30. With fingers 32 in their normal nonelastically deformed state, a screwdriver may be used to turn tuning screw section 24. In this loose position shown in FIG. 3, outer surface 33 of fingers 32 do not yet engage surface 54 and thus fingers 32 are not deformed inwardly. It will be understood that as imaginary extension of surface 54 forms an angle with transverse axis 26*a* which is slightly smaller in value than the angle formed by an imaginary extension of surface 33 with respect to axis 26*a*. Thus, for example, surface 54 may form an angle of 60° while surface 33 may form an angle of 61°. The reason for this slight difference in angles is that it is desired that as movement portion 28 is rotated and moves downwardly, fingers 32 at their ends (lower edge 33*a* of surface 33) first engage the lower edge 54*a* of surface 54 (the intersection of surface 54 and inner wall surface 12*a*). In this way, a "wedge action" is provided as fingers 33 are elastically deformed simultaneously inwardly toward plug portion 44 until a fully engaged position is reached as shown in FIG. 2. In this fully engaged position, the difference in the angles of surfaces 33 and 54 is effective to provide a positive shorting contact from edge 54*a* to edge 33*a* to plug 44 at interface 60 on inner cavity wall surface 12*a*.

In operation of assembly 10, tuning screw section 24 is first inserted within chuck section 22 at an approximate desired position. In this approximate position, plug portion 44 extends out of the bottom of gripping portion 30 at a distance it is desired that plug 44 extend beyond surface 12*a* into cavity 20. Chuck section 22 is then screwed into threaded opening 11 until tapered surface 33 just engages seating surface 54. In this way, chuck section 22 "bottoms" and by further rotating the section by means of a spanner wrench, fingers 32 are cammed and compressed by surface 54 until the spring force of the fingers becomes substantially equal to the effective force rotating chuck section 22. In this position, tuning screw section 24 may still be turned manually by means of a screwdriver since the gripping frictional force exerted between gripping section 36*a* of fingers 32 and plug portion 44 is not sufficient to prevent section 24 from being rotated. Accordingly, tuning screw section 24 may then be rotated to a permanent position for a desired extension *a* of plug portion 44 from cavity wall surface 12*a* into cavity 20. With tuning screw section 24 set, chuck section 22 may then be further rotated a very small increment such as 1° or 2° to provide the locking action in which fingers 32 will then tightly and fully engage plug portion 44 as shown in FIG. 2.

It will now be understood that tuning screw assembly 10 provides a short circuit condition precisely at interface 60 of cavity wall surface 12*a* and plug portion 44. This circular interface 54*a* at surface 12*a* avoids objectionable introduction of resistive components caused by extra path length previously described. In addition, assembly 10 provides sure repeatability and avoids noisy tuning of the prior art.

It has been found preferable to first assemble tuning screw section 24 in chuck section 22 before installing the chuck section within opening 11. The reason is that without section 24 in place, chuck section 22 may be rotated beyond a position in which it would be possible to then insert tuning screw section 24.

Another embodiment of the invention is shown in FIG. 6 in which there is avoided the necessity of machining an inner taper in the wall opening 11 as shown in FIGS. 1–3. Specifically, in FIG. 6, it is only necessary to form threads 35*a* throughout a wall opening 11*a*. Assembly 10*a* includes a machined insert 70 which threadedly engages threads 35*a* and is held in place by a hex lock nut 72 on outer cavity wall surface 68*b*. Chuck section 22*a* and tuning screw section 24*a* may be identical with sections 22 and 24 of FIG. 5 except as shown in FIG. 6 slots 74 maybe formed in upper surface 50*a* for use in rotating section 22*a*.

An advantage of assembly 10*a* is that insert 70, chuck section 22*a* and tuning screw section 24*a* may all be assembled in advance, by a manufacturer for example, to provide a predetermined stub extension of portion 44. In this way, extension *a* may be accurately determined prior to being installed in the field. The operator then only has to thread insert 70 within wall 68 and align inner surface 76 of insert 70 with inner wall surface 68*a* of the cavity.

Figure 7:
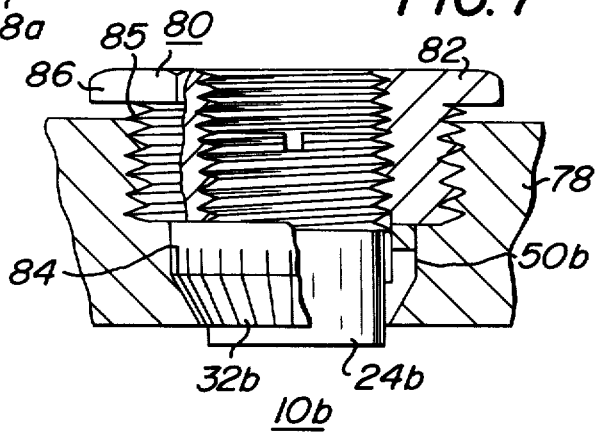
FIG. 7 is a further embodiment of the invention in which the chuck section is formed of separable gripping portions.

In the embodiment of FIG. 7, the wall of cavity 78 is threaded and tapered with a reduced section 50*b* in the manner shown in FIGS. 1–3. Tuning screw assembly 10*b* comprises a tuning screw section 24*b* similar to that of assembly 10 while chuck section 80 comprises a movement portion 82 separate from a gripping portion 84. Movement portion 80 may be made of hex stock with threads 85 formed on its lower section while its upper section 86 is maintained as hex stock to receive a wrench. Accordingly, by rotating movement portion 80, gripping portion 84 is pushed downwardly with the resultant deforming of fingers 32*b* in the manner previously described. It will be understood that the two-piece chuck section may be used in tuning assemblies 10 and 10*a*.

Figure 8:
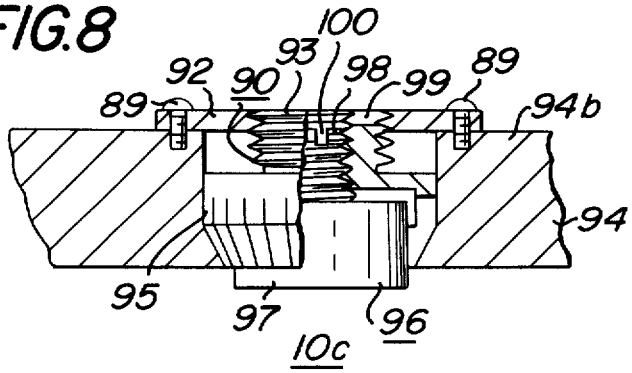
FIG. 8 is a still further embodiment of the invention having a rigidly secured plate.

A one piece chuck section 90 is used in tuning screw assembly 10*c* of the embodiment of FIG. 8. Plate 92 is secured to outer wall surface 94*b* of wall 94 by means of locking screws 89. Chuck section 90 has a gripping portion 95 and a movement portion 93 which threadedly engages an opening of plate 92. Tuning screw section 96 has a lower plug portion 97 which is similar to portion 44 of assembly 10. However, the threaded portion 98 is of reduced outer diameter with respect to portion 97 since it is received in an inner threaded chamber of movement portion 93.

In operation of assembly 10*c*, movement portion 93 is rotated by means of slots 99 formed on the upper surface thereof. Further, tuning screw section 96 is rotated by means of a slot 100 formed on the upper surface of threaded portion 98.

Figure 9:
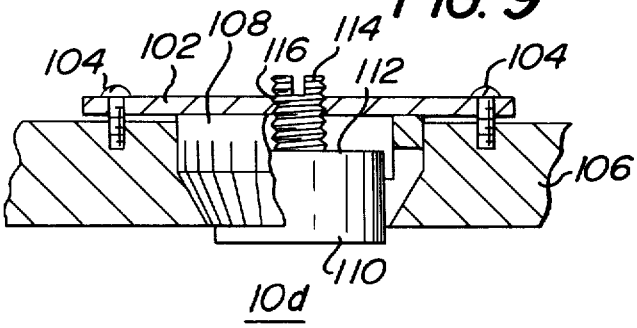
FIG. 9 is a still further embodiment of the invention having an adjustable plate.

Tuning screw assembly 10*d* of FIG. 9 also has a plate 102 as in assembly 10*c*. However, plate 102 is effective by means of screws 104 threadedly engaged in wall 106 to apply a longitudinal force to a separate gripping portion 108. In order that this force may be applied, it will be understood that the long length of gripping portion 108 is required to be somewhat greater in value than the width of wall 106. In order to provide for rotation of tuning screw section 112, there is provided an upper threaded portion 114 which is threadedly received in an opening 116 in plate 102.

The gripping portion of assemblies 10*a–d* may be made of any suitable spring material such as beryllium copper, phosphor bronze or spring steel.

It will be understood that the above described tuning screw assemblies may be used not only in cavity resonator 14 but also in waveguides both hollow and coaxial. Thus, for example, walls 12, 16, 78, 94 and 106 may be considered to be walls of waveguides within which are installed tuning screw assembly according to the invention. In conventional manner, the tuning screw portion is effective to tune the electrical length of the waveguide or introduce reactive discontinuities for impedance matching.

What is claimed is:

1. A tuning screw assembly for use in a cavity or waveguide comprising a tuning screw section received within an opening in a wall of said cavity or waveguide, chuck means including a gripping portion disposed between said wall and said tuning screw section and having elastically deformable fingers, said wall including a seating surface tapered inwardly toward and forming a seat for engaging an outer surface of said gripping portion, and said chuck means including a movement portion for selectively positioning the longitudinal position of said gripping portion within said opening to provide a positive shorting contact from said wall through said gripping portion to said tuning screw section when said gripping portion is positioned by said movement portion to engage said seating surface and said fingers are elastically deformed smultaneously inwardly to grip said tuning screw section.

2. The tuning screw assembly of claim 1 in which said wall has an inner wall surface within said cavity or waveguide and said positive shorting contact is substantially disposed at said inner wall surface.

3. The tuning screw assembly of claim 2 in which said movement portion is formed integral of larger outer diameter than said gripping portion and has external threads on an outer surface for threaded engagement with internal threads formed in said wall.

4. The tuning screw assembly of claim 2 in which said movement portion is formed separately of said gripping portion and includes a plate secured to an outer wall surface of said cavity or said waveguide.

5. The tuning screw assembly of claim 2 in which said opening and said chuck means have the same longitudinal dimension and the same transverse dimension.

6. The tuning screw assembly of claim 5 in which said seating surface forms with a transverse axis an angle slightly smaller in value than that formed by said transverse axis with said outer surface of said gripping portion whereby said fingers are elastically deformed to provide positive shorting contact from an outer edge of said seating surface remote from said movement portion through said gripping portion to said tuning screw assembly section.

7. A microwave tuning screw assembly mounted in an opening in a cavity or waveguide and having positive shorting at an inner wall surface of said cavity or waveguide comprising chuck means having a major portion thereof disposed in said opening and having elastically deformable fingers within said opening, a tuning screw section received within said fingers, and means for deforming said fingers towards said tuning screw section thereby to provide positive shorting from said inner wall surface through said chuck means to said tuning screw section.

8. The tuning screw assembly of claim 7 in which said chuck means and said opening have the same longitudinal dimension and the same transverse dimension, said chuck means including a movement portion for selectively positioning the longitudinal position of said deformable fingers within said opening.

9. The tuning screw assembly of claim 8 in which the wall of said opening has a seating surface tapered inwardly toward and forming a seat for engaging an outer surface of said fingers also tapered inwardly whereby as said fingers are positioned to engage said seating surface they are simultaneously elastically deformed inwardly to grip said tuning screw assembly.

10. The tuning screw assembly of claim 9 in which said seating surface forms with a transverse axis an angle slightly smaller in value than that formed by said transverse axis with said outer tapered surface of said fingers whereby said fingers are elastically deformed to provide positive shorting contact from an outer edge of said seating surface remote from said movement portion through said fingers to said tuning screw assembly.

11. The tuning screw assembly of claim 10 in which said movement portion is formed separately of said fingers and includes a plate adjustably secured to an outer wall surface of said cavity or said waveguide thereby to provide said selective positioning of said fingers.

12. The tuning screw assembly of claim 10 in which said movement portion is formed integral with said fingers and has external threads on an outer surface for threaded engagement with internal threads formed in said wall of said opening.

13. The tuning screw assembly of claim 12 in which said tuning screw section includes a threaded portion threadedly engaged within an inner threaded opening of said chuck means.

* * * * *